US006586866B1

(12) United States Patent
Ikedo et al.

(10) Patent No.: US 6,586,866 B1
(45) Date of Patent: Jul. 1, 2003

(54) GAS DISCHARGE TUBE HAVING PRECISE ELECTRODE ARRANGEMENT

(75) Inventors: Tomoyuki Ikedo, Shizuoka-ken (JP); Kouzou Adachi, Shizuoka-ken (JP); Yoshinobu Ito, Shizuoka-ken (JP); Ryotaro Matui, Shizuoka-ken (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 272 days.

(21) Appl. No.: 09/599,399

(22) Filed: Jun. 22, 2000

Related U.S. Application Data

(63) Continuation-in-part of application No. PCT/JP98/05820, filed on Dec. 22, 1998.

(30) Foreign Application Priority Data

| | | |
|---|---|---|
| Dec. 24, 1997 | (JP) | 9-355352 |
| Sep. 7, 1998 | (JP) | 10-252589 |
| Sep. 7, 1998 | (JP) | 10-252590 |
| Sep. 7, 1998 | (JP) | 10-252595 |
| Sep. 7, 1998 | (JP) | 10-252603 |

(51) Int. Cl.[7] ..... H01J 1/88; H01J 19/42

(52) U.S. Cl. ..... 313/238; 313/292; 313/613; 313/634

(58) Field of Search ..... 313/238, 613, 313/614, 239, 240, 292, 293, 634, 25, 112

(56) References Cited

U.S. PATENT DOCUMENTS

| | | | | |
|---|---|---|---|---|
| 3,956,655 A | * | 5/1976 | Pevo | 313/112 |
| 4,910,431 A | * | 3/1990 | Witt et al. | 313/112 |
| 5,057,742 A | * | 10/1991 | Kawai et al. | 313/242 |
| 5,241,182 A | | 8/1993 | Martin et al. | 250/396 R |
| 6,380,663 B1 | * | 4/2002 | Ikedo et al. | 313/25 |

FOREIGN PATENT DOCUMENTS

| | | |
|---|---|---|
| EP | 0 700 071 | 3/1996 |
| EP | 0 727 810 | 8/1996 |
| JP | 7-326324 | 12/1995 |
| JP | 8-77965 | 3/1996 |
| JP | 8-77969 | 3/1996 |
| JP | 8-77979 | 3/1996 |
| JP | 8-222185 | 8/1996 |
| JP | 8-222186 | 8/1996 |
| JP | 8-236081 | 9/1996 |

* cited by examiner

*Primary Examiner*—Ashok Patel
*Assistant Examiner*—Karabi Guharay
(74) *Attorney, Agent, or Firm*—Morgan, Lewis & Bockius LLP

(57) ABSTRACT

In a gas discharge tube in which a sealed envelope at least a part of which transmits light is filled with a gas, and electric discharge is generated between anode and cathode sections disposed within the sealed envelope, so as to emit predetermined light outside from the light-transmitting part of the sealed envelope, the anode section is mounted on an insulating anode support member, an insulating electrode support member having an opening for exposing the anode section is mounted on a surface surrounding the anode section, a focusing electrode having a focusing opening projecting toward the anode section is further mounted at the front face of the opening, and the cathode section is disposed on the anode support member or focusing electrode support member so as to be spaced from the focusing opening.

9 Claims, 14 Drawing Sheets

GAS DISCHARGE TUBE HAVING PRECISE ELECTRODE ARRANGEMENT

RELATED APPLICATION

This is a Continuation-In-Part application of International Patent Application Ser. No. PCT/JP98/05820 filed on Dec. 22, 1998, now pending.

BACKGROUND OF THE INVENTION

1. Field of the Invention

The present invention relates to a gas discharge tube; and, in particular, to a gas discharge tube for use as a light source for a spectroscope, chromatography, or the like.

2. Related Background Art

As techniques in such a field, those disclosed in Japanese Patent Application Laid-Open Nos. HEI 7-326324, HEI 8-77979, and HEI 8-222185 have conventionally been known. In the gas discharge tubes described in these publications, a sealed envelope is constituted by a side tube made of glass and a stem made of glass. Plugged into the stem are stem pins securing anode and cathode sections, respectively. The sealed envelope is filled with about several Torr of deuterium gas, for example. Such a gas discharge tube is called deuterium lamp and is utilized as a stable UV light source.

SUMMARY OF THE INVENTION

In order to carry out point emission, such a deuterium lamp is configured such that a focusing electrode plate having a small hole at its center is positioned at the front face of the anode section, i.e., on the cathode section side, so as to converge the thermions generated in the cathode section. The distance between the focusing electrode plate and the anode section is the most influential parameter for point emission characteristics, and various techniques have been developed for improving and maintaining its accuracy.

Though the techniques developed so far can achieve the accuracy, it requires a skill for processing and assembling, and materials themselves become expensive, whereby it has been problematic in the easiness and stability of processing/assembling, in terms of cost, and so forth.

In view of these problems, it is an object of the gas discharge tube in accordance with the present invention to provide a gas discharge tube which is easy to process/assemble, can be made stably, and can cut down the cost.

For overcoming the above-mentioned problems, the gas discharge tube in accordance with the present invention is a gas discharge tube having a sealed envelope at least a part of which transmits light, the sealed envelope being filled with a gas and being provided with anode and cathode sections disposed therein, electric discharge being generated between the anode and cathode sections, so that the light-transmitting part of the sealed envelope emits predetermined light outside. The gas discharge tube comprises an insulating anode support member mounting the anode section, an insulating focusing electrode support member, mounted on a surface of the anode support member surrounding the anode section, having an opening on the anode section, and a focusing electrode, securely disposed at a front face of the opening of the focusing electrode support member, having a focusing opening projecting toward the anode section. The cathode section is disposed on the anode support member or focusing electrode support member so as to be spaced from the focusing opening.

As a consequence of such a configuration, when the anode section and the focusing electrode support member are mounted on the anode support member, and the focusing electrode is disposed at the front face of the focusing electrode support member, whereas the cathode section is spaced from the focusing electrode, then the respective electrodes can be assembled with a highly accurate positional relationship in a simple operation. While the accuracy in their positional relationship depends on the precision of the anode support member and focusing electrode support member, the respective support members are separated from each other, whereby the precision in the securing portion of each electrode can easily be enhanced, and the manufacturing cost can be cut down.

Preferably, the anode support member has a cavity portion for mounting the anode section. As a consequence, it becomes quite easy to secure the anode section.

The anode section may be secured by being held between the anode support member and the focusing electrode support member. As a consequence, not only the accuracy in securing the anode section but also the accuracy in distance between the anode section and focusing electrode can further be improved.

Preferably, the anode support member and focusing electrode support member are made of ceramics. This makes it easier to improve the processing and precision, and can cut down the manufacturing cost as well.

Preferably, the anode support member or focusing electrode support member have pin holes through which stem pins securing the anode section, cathode section, and focusing electrode to the sealed envelope, respectively, penetrate. As a consequence, each electrode can be secured more reliably, and the accuracy in positional relationship improves.

Preferably, the anode support member is disposed in contact with a stem forming a bottom face of the sealed envelope. As a consequence, the heat generated in the anode and focusing electrode are rapidly transmitted to the stem by way of the focusing electrode support member and the anode support member, whereby fluctuations in the mutual positional relationship between the anode and focusing electrode which may occur due to their thermal deformations can be prevented from occurring.

The present invention will become more fully understood from the detailed description given hereinbelow and the accompanying drawings. They are given by way of illustration only, and thus should not be considered limitative of the present invention.

Further scope of applicability of the present invention will become apparent from the detailed description given hereinafter. However, it is clear that the detailed description and specific examples, while indicating preferred embodiments of the invention, are given by way of illustration only, and various changes and modifications within the spirit and scope of the invention will become apparent to those skilled in the art from this detailed description.

BRIEF DESCRIPTION OF DRAWINGS

FIG. 4 is a plan view of the stem in FIG. 1, whereas

FIG. 9 is a plan view of the anode section in FIG. 1, whereas

FIG. 14 is a plan view of the focusing electrode plate in FIG. 1, whereas

FIG. 16 is a plan view showing the aperture plate in FIG. 1, whereas

DETAILED DESCRIPTION OF PREFERRED EMBODIMENTS

Figure 1:
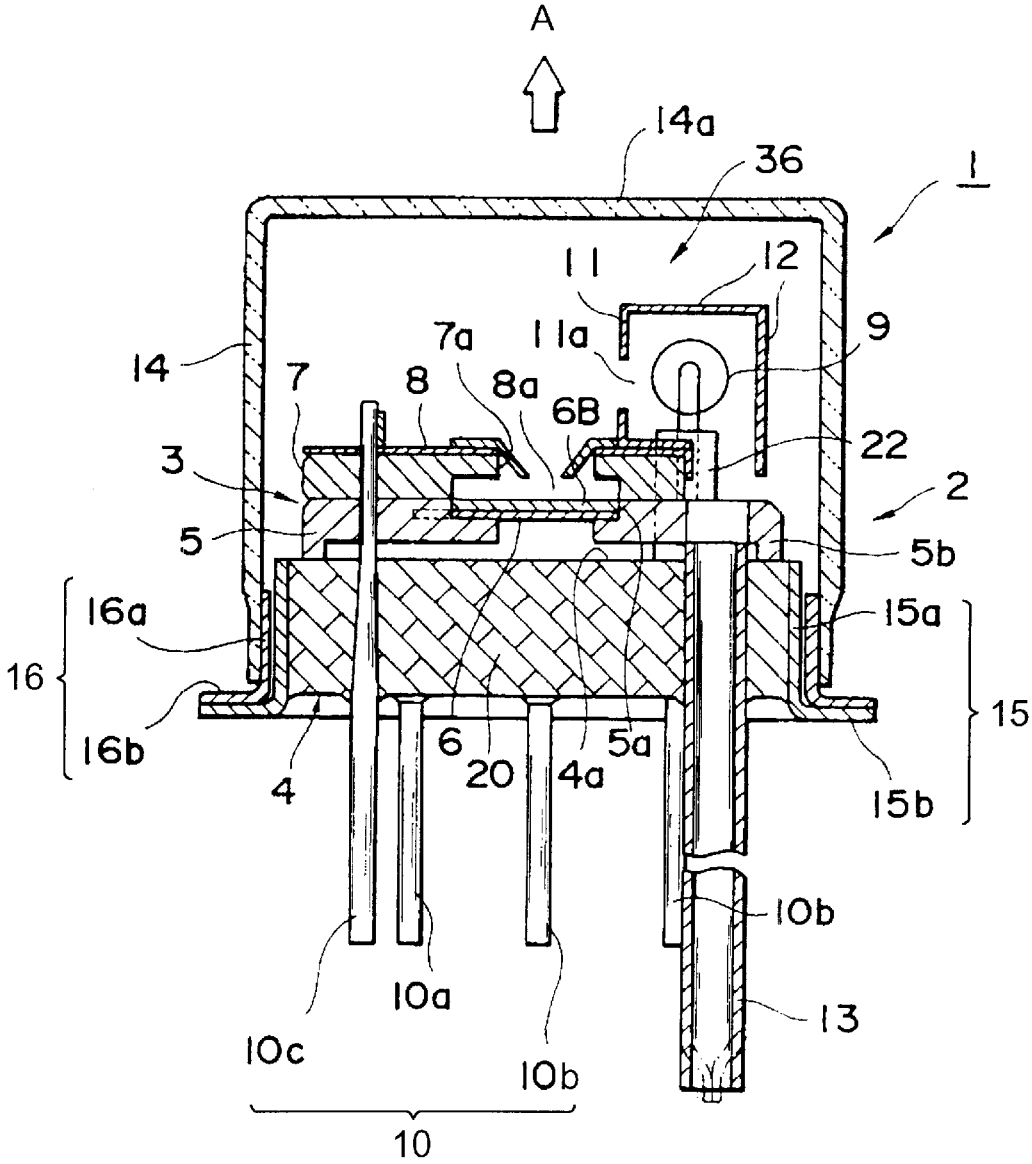
FIG. 1 is a sectional view showing a first embodiment of the gas discharge tube in accordance with the present invention.

In the following, some of preferred embodiments of the gas discharge tube in accordance with the present invention will be explained in detail with reference to the accompanying drawings. To facilitate the comprehension of the explanation, the same reference numerals denote the same parts, where possible, throughout the drawings, and a repeated explanation will be omitted.

FIG. 1 is a sectional view showing the gas discharge tube of a first embodiment in accordance with the present invention. The gas discharge tube 1 shown in this drawing is a head-on type deuterium lamp and has a sealed envelope 2 filled with about several Torr of deuterium gas in order to generate ultraviolet rays, whereas a light-emitting part assembly 3 is contained in the sealed envelope 2. The light-emitting part assembly 3 has an electrically insulating anode support plate 5 which is made of ceramics and disposed on a stem 4 so as to be in contact therewith. A planar anode section 6 is held on the anode support plate 5, so as to be spaced from the stem 4. The upper face of the anode support plate 5 is provided with a cavity portion 5*a* having a form substantially identical to that of the anode section 6, and the anode section 6 is contained within the cavity portion 5*a*.

Since the anode section 6 employs a configuration in which it is seated on the stem 4 with the anode support plate 5 interposed therebetween, the anode section 6 can be accurately disposed on the stem 4 when being secured to the latter. Also, a simple operation of just mounting the anode support plate 5 onto the stem 4 assembles the anode section 6 into the sealed envelope 2, thereby improving the workability. Also, as a result of employing a configuration in which the anode support plate 5 abuts against the upper face 4*a* of the stem 4, the high heat generated from the anode section 6 at the time of use of the gas discharge tube 1 is transmitted to the stem 4 by way of the anode support plate 5, and then is released outside by way of the stem 4. As a consequence, it can improve the cooling efficiency of the anode section 6, thus contributing to the improvement in stabilizing operation characteristics.

A stem pin 10*a* secured so as to penetrate through the stem 4 penetrates through the anode support plate 5, whereas the anode section 6 is secured to the upper end of the stem pin 10*a* by welding. Also, a focusing electrode support plate 7 made of ceramics is disposed on the anode support plate 5 so as to be in contact therewith. A focusing electrode 8 secured to the upper end of the stem pin 10*c* is disposed on the focusing electrode support plate 7, whereas a focusing opening 8*a* formed in the focusing electrode plate 8 is disposed coaxial with the opening 7*a* of the focusing electrode support plate 7 so as to face therein, whereby the focusing electrode plate 8 and the anode section 6 are opposed each other.

For assembling such a light-emitting part assembly 3, it will be sufficient if the anode support plate 5, the anode section 6, the focusing electrode support plate 7, and the focusing electrode plate 8 are successively stacked on the stem 4. As a consequence, stable mass production is facilitated when making the gas discharge tube 1. Also, since the light-emitting part assembly 3 does not have a floating structure, it is secured within the sealed envelope 2, whereby their positional relationship can be held with a high accuracy.

Further, in the light-emitting part assembly 3, a cathode section 9 is provided beside the focusing opening 8*a* so as to be spaced from the focusing electrode plate 8. The cathode section 9 is positioned on the upper side from the focusing electrode support plate 7, while being welded and secured to the upper end of a stem pin 10*b* secured to the stem 4, and generates thermions as a voltage is applied thereto. Between the cathode section 9 and the focusing opening 8*a*, a discharge rectifying plate 11 is disposed at a position deviated from an optical path (in the direction directly upward from the focusing opening 8*a* in the drawing, i.e., the direction of arrow A). The discharge rectifying plate 11 is provided with an electron releasing window 11*a* formed as a rectangular opening for transmitting therethrough thermions generated in the cathode section 9. Also, the discharge rectifying plate 11 is welded and secured to the upper face of the focusing electrode plate 8, and is provided with a cover plate 12 having an L-shaped cross section so as to surround the upper side of the cathode section 9 and the rear side thereof opposite from the electron releasing window 11*a*. The cover plate 12 keeps the sputtering materials or evaporated materials released from the cathode section 9 from attaching to a light projection window 14*a* disposed at the top part of the sealed envelope 2.

While thus configured light-emitting part assembly 3 is disposed within the sealed envelope 2, an exhaust pipe 13 is secured to the stem 4 since it is necessary for the sealed envelope 2 to be filled with several Torr of deuterium gas. Utilizing this exhaust pipe 13, the sealed envelope 2 can be appropriately filled with a predetermined pressure of deuterium gas after the air is once evacuated therefrom. After the filling, the exhaust pipe 13 is closed, whereby the sealed envelope 2 is sealed off.

Here, the sealed envelope 2 is made hermetic as the junction between a side tube 14 made of silica glass or UV-transmitting glass and the stem 4 is sealed. This side tube 14 is formed like a cylinder whose one side is open, while its top part is utilized as the circular light projection window 14*a*. The stem 4 is formed like a cylindrical column, whose peripheral portion is provided with a first junction member 15 made of a metal (e.g., made of a Kovar metal). The first joint member 15 comprises a cylindrical body portion 15*a*, and a first flange portion 15*b* radially extending like a brim from the lower end of the body portion 15*a*. The body portion 15*a* of the first joint member 15 is secured to the outer wall face of the stem 4 by fusion or bonding.

On the other hand, the open end side of the side tube 14 is provided with a second joint member 16 made of a metal (e.g., made of a Kovar metal), which comprises a cylindrical body portion 16*a* and a second flange portion 16*b* radially extending like a brim from the lower end of the body portion 16*a*. Here, the body portion 16*a* of the second joint member 16 is secured to the inner wall face of the side tube 14 by fusion or bonding, and its positioning is effected by a simple operation of mounting the open end part of the side tube 14 onto the flange portion 16*b*.

Figure 2:
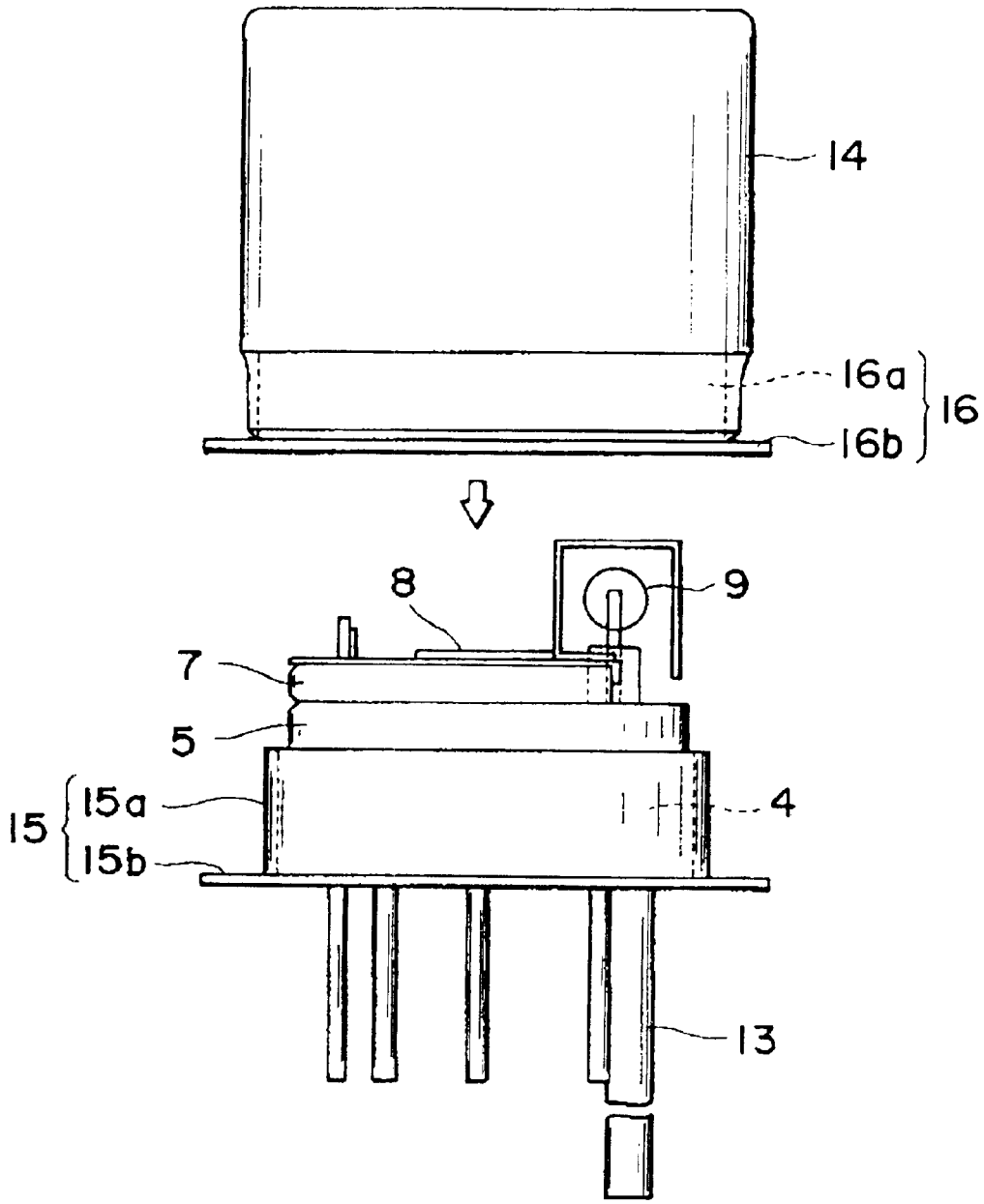
FIG. 2 is a front view of the gas discharge tube shown in FIG. 1 showing a state before its stem and side tube are welded to each other.

Hence, as shown in FIG. 2, while the stem 4 is being inserted into the side tube 14 in a state where the light-emitting part assembly 3 is secured onto the stem 4, the metal flange portion 15*b* of the stem 4 and the metal flange portion 16*b* of the side tube 14 are brought into close contact with each other and, with this state being maintained, thus joined part is subjected to a welding operation such as electric welding, laser welding, or the like, so as to effect hermetic sealing of the sealed envelope 2. After this welding operation, the air in the sealed envelope 2 is evacuated through the exhaust pipe 13, the sealed envelope 2 is subsequently filled with about several Torr of deuterium gas, and the exhaust pipe 13 is closed thereafter, whereby the assembling operation is completed. Here, the first flange portion 15*b* is utilized as a reference position with respect to the light-emitting part of the gas discharge tube 1 (the part where arc balls are generated in front of the focusing opening 8*a*). Namely, when the positional relationship between the first flange portion 15*b* and the light-emitting part is kept constant upon assembling the discharge tube 1, the positioning of the light-emitting part becomes easier, whereby the assembling workability and positioning accuracy of the gas discharge tube 1 with respect to an apparatus for driving the gas discharge tube 1 (not shown) are expected to improve.

Individual components of the light-emitting part assembly disposed within the sealed envelope 2 and the stem 4 will now be explained in detail.

Figure 3:
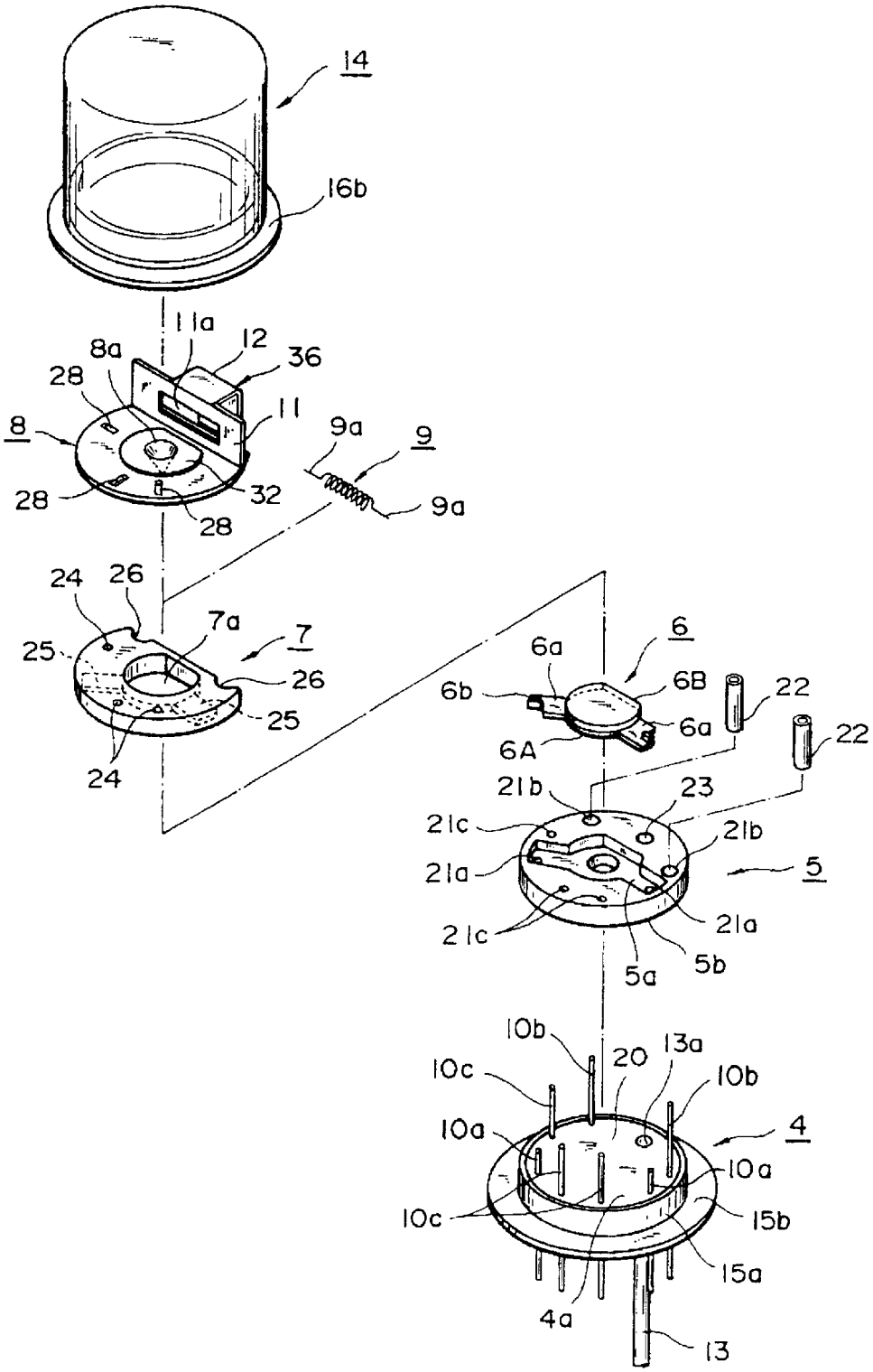
FIG. 3 is an exploded perspective view of the gas discharge tube shown in FIG. 1.
Figure 4:
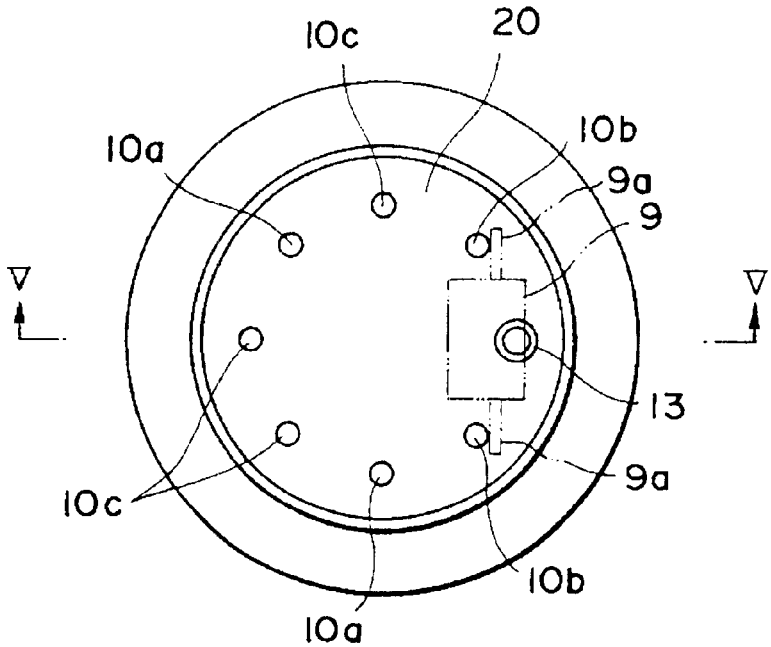
Figure 5:
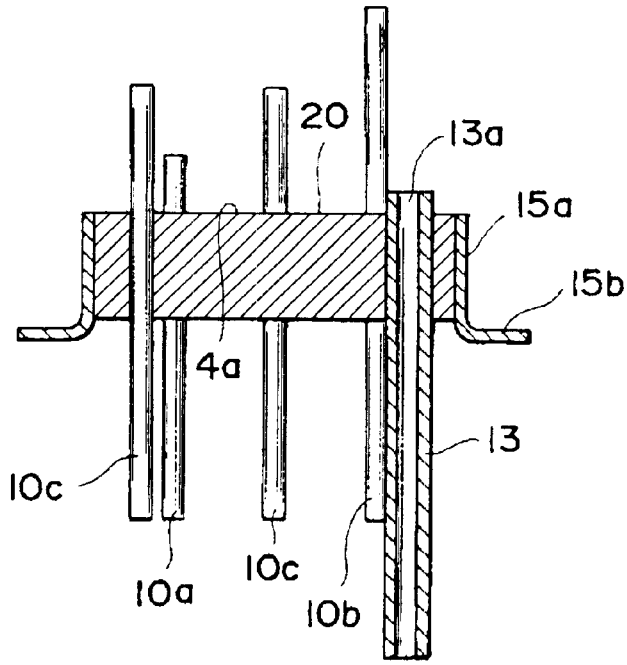
FIG. 5 is a sectional view thereof taken along the line V—V.
Figure 6:
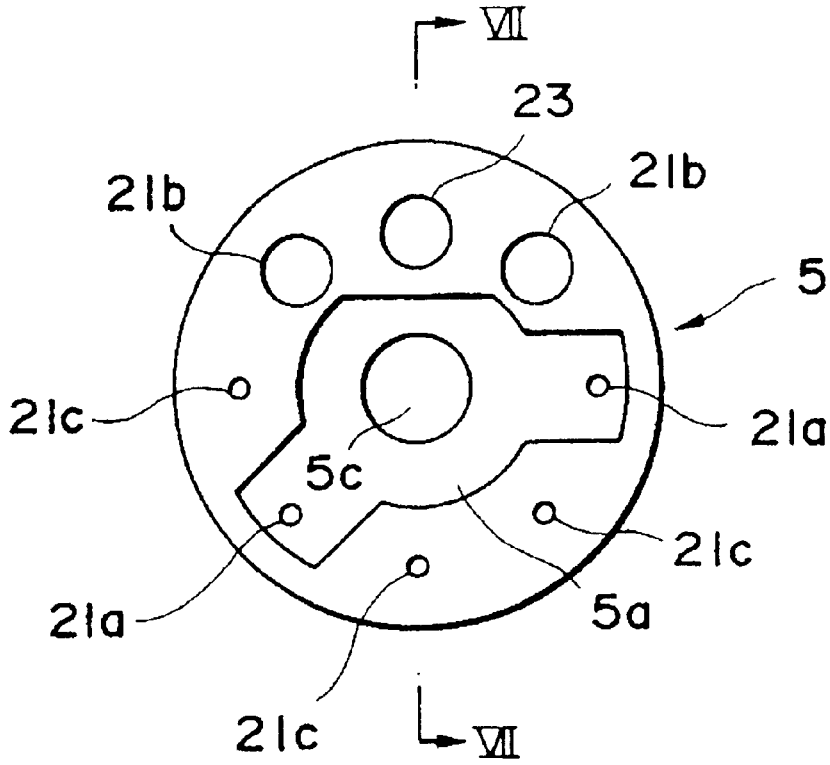
FIG. 6 is a plan view of the anode support plate in FIG. 1.
Figure 7:
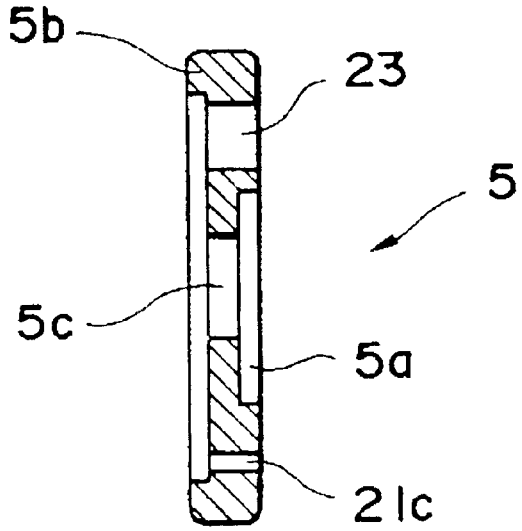
FIG. 7 is a sectional view thereof taken along the line VII—VII.
Figure 8:
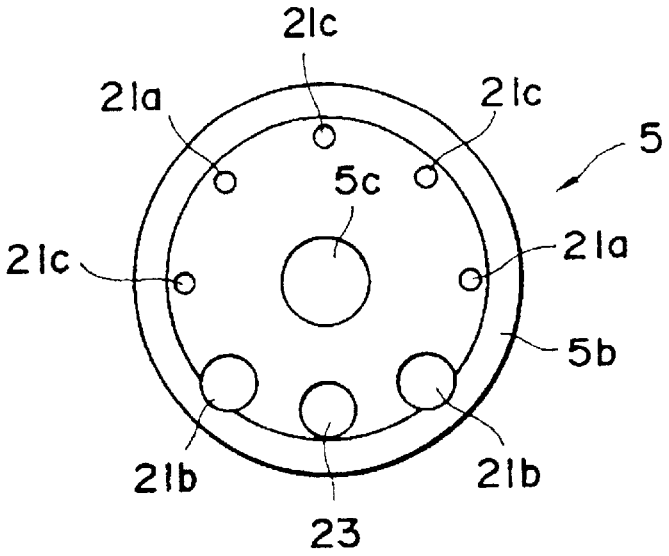
FIG. 8 is a bottom view thereof.

As shown in FIGS. 3 to 5, the stem 4 has a cylindrical base 20 made of Kovar glass at its center, whereas seven stem pins 10 are secured to the base 20 so as to penetrate therethrough and are arranged annularly. The stem pins 10 are constituted by two anode section stem pins 10*a* whose upper ends are secured to the anode section 6 so as to be electrically continuous therewith, two cathode section stem pins 10*b* whose upper ends are secured to the cathode section 9 so as to be electrically continuous therewith, and three focusing electrode plate stem pins 10*c* whose upper ends are secured to the focusing electrode plate 8 so as to be electrically continuous therewith. The individual stem pins 10 are set to different lengths such that the surface positions of the anode section 6, focusing electrode plate 8, and cathode section 9 disposed within the sealed envelope 2 successively rise in this order. Namely, among the stem pins 10, their amounts of upward projection from the upper face 4*a* of the base 20 successively increase in the order of the stem pins 10*a*, 10*c*, and 10*b*.

The first joint member 15 made of a metal (e.g., made of a Kovar metal or stainless steel) is secured to a peripheral part of the base 20 of the stem 4, whereas the first joint member 15 is constituted by the cylindrical body portion 15*a* and the first flange portion 15*b* radially extending like a brim from the lower end of the body portion 15*a*. Here, the body portion 15*a* of the first joint member 15 is secured to the outer wall face of the stem 4 by fusion or bonding. The exhaust pipe 13 is secured near the outer periphery of the base 20 such that a ventilation port 13*a* of the exhaust pipe 13 faces between the two cathode section stem pins 10*b*. The ventilation port 13*a* of the exhaust pipe 13 is thus not disposed at the center of the base 20 but shifted to an end thereof and is located substantially directly under the cathode section 9 so as to correspond thereto, in order to rapidly aspirate the gases liberated upon activating the cathode section 9 by energization during the assembling step of the gas discharge tube 1.

As shown in FIGS. 3 and 6 to 8, the ceramics-made anode support plate 5 made of an electrically insulating material is formed like a disk whose upper face is provided with the cavity portion 5*a* having a form matching the anode section 6, whereas the peripheral portion of the lower face of the anode support plate 5 is provided with a ring-shaped pedestal 5*b* for abutting against the upper face of the base 20. The center of the anode support plate 5 is provided with a circular through hole 5*c*. Also, the anode support plate 5 is provided with seven pin holes 21 through which the stem pins 10 penetrate, whereas the pin holes 21 are arranged annularly. The pin holes 21 are constituted by two pin holes 21*a* through which the anode section stem pins 10*a* penetrate, two pin holes 21*b* through which the cathode section stem pins 10*b* penetrate, and three pin holes 21*c* through which the focusing electrode plate stem pins 10*c* penetrate, whereas the individual pin holes 21*a* to 21*c* are disposed so as to correspond to the respective positions of the stem pins 10*a* to 10*c*.

Each of the pin holes 21*b* has a diameter greater than that of the other pin holes 21*a*, 21*c*, in order for a ceramics-made electrically insulating pipe 22 (see FIG. 3) to be inserted therein. As the stem pin 10*b* is inserted into the pipe 22, the exposed part of the stem pin 10*b* in the sealed envelope 2 becomes smaller, thereby reliably preventing abnormal electric discharge from occurring in the stem pin 10*b* (see FIG. 1). Here, a ventilation hole 23 into which the ventilation port 13*a* of the exhaust pipe 13 faces is disposed between the two pin holes 21*b*.

Figure 9:
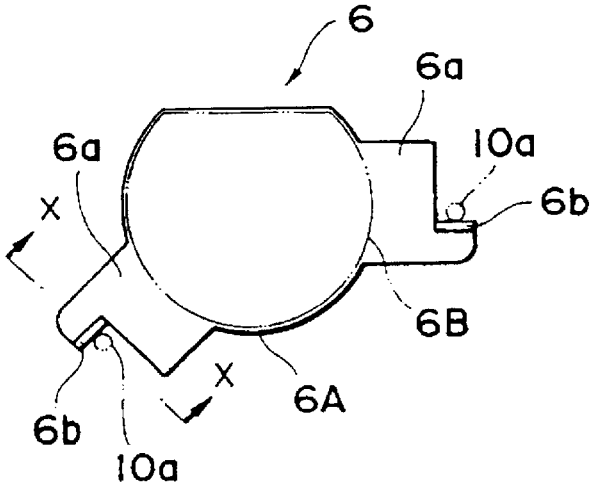
Figure 10:
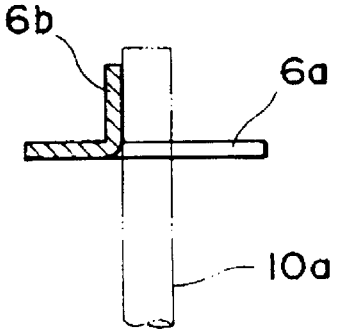
FIG. 10 is an enlarged sectional view thereof taken along the line X—X.
Figure 11:
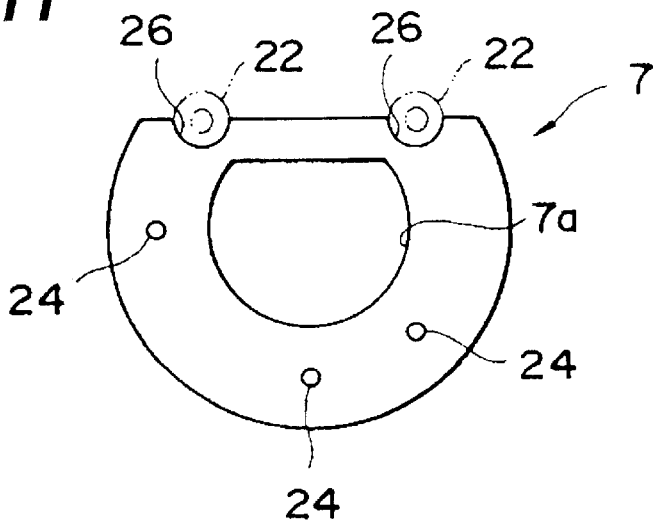
FIG. 11 is a plan view of the focusing electrode support plate in FIG. 1.

As shown in FIGS. 3, 9, and 10, the metal-made anode section 6 comprises a base plate 6A having lead portions 6*a* extending on both sides, and an anode plate 6B which is substantially shaped like a half moon and secured onto the base plate 6A by welding. The free end of each lead portion 6*a* is provided with a riser 6*b* formed by bending. Since the lead portions 6*a* are provided with the respective risers 6*b*, it becomes easier for the upper ends of the stem pins 10*a* to be secured to the anode section 6 by welding. Since the planar anode section 6 composed of the base plate 6A and anode plate 6B is contained in the cavity portion 5*a* of anode support plate 5 having an outer form substantially identical thereto, the anode section 6 can stably be seated within the anode support plate 5, a wall face forming the cavity portion 5*a* can surround the anode section 6, whereby an electric shield effect can be expected.

Figure 12:
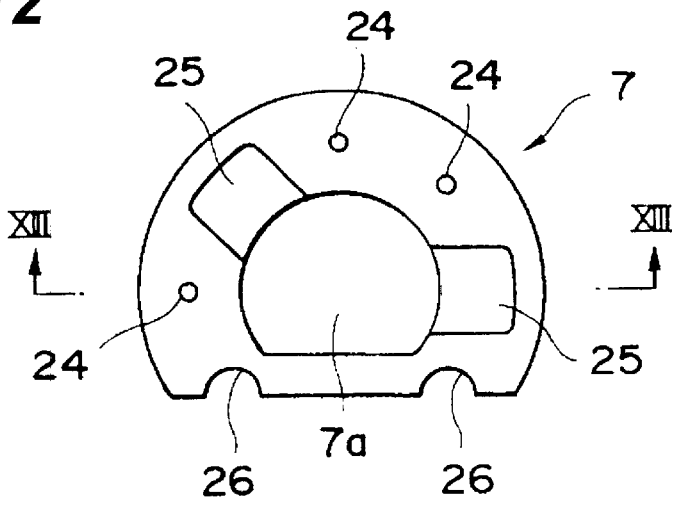
FIG. 12 is a bottom view thereof.
Figure 13:
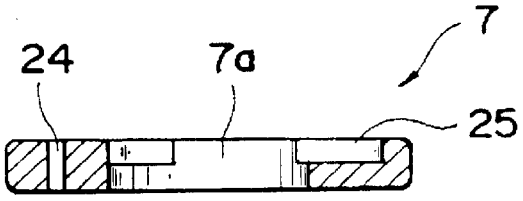
FIG. 13 is a sectional view thereof taken along the line XIII—XIII.

As shown in FIGS. 3 and 11 to 13, the ceramics-made focusing electrode support plate 7 substantially shaped like a half moon has the opening 7*a* substantially matching the form of the anode plate 6B, the surroundings of the opening 7*a* are provided with three pin holes 24 through which the respective upper ends of the stem pins 10*c* penetrate, and a depressed release portion 25 is disposed on the rear face of the focusing electrode support plate 7 at a position corresponding to each lead portion 6*a* of the anode section 6 (see FIG. 12). When such release portions 25 are provided, then the risers 6*b* of the anode section 6 are securely kept from abutting against the focusing electrode support plate 7. Further, the periphery of the focusing electrode support plate 7 is provided with half-moon-shaped cutouts 26 for receiving the respective ceramics-made pipes 22.

Figure 14:
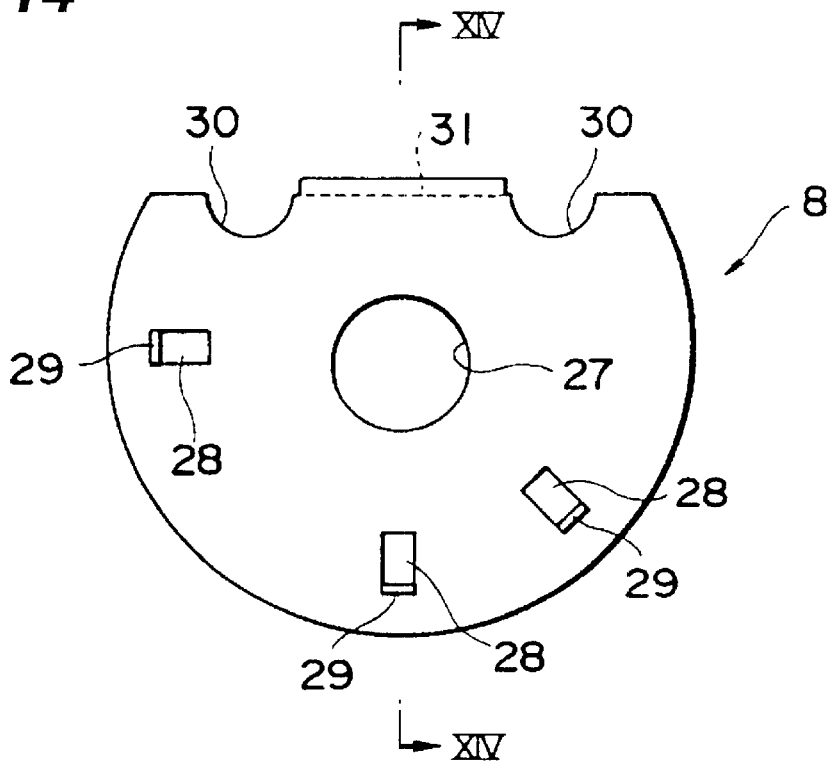
Figure 15:
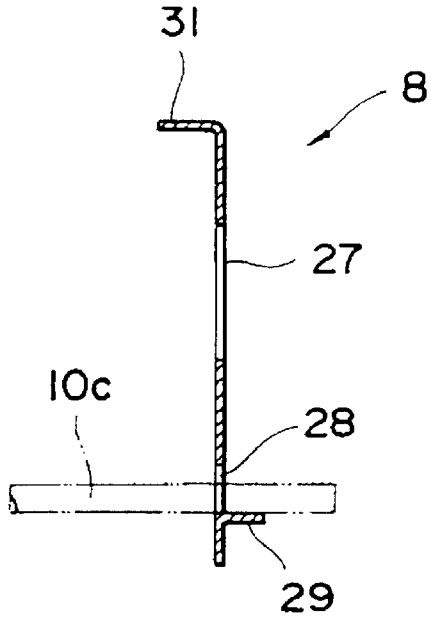
FIG. 15 is a sectional view thereof taken along the line XIV—XIV.

As shown in FIGS. 3, 14, and 15, the metal-made focusing electrode plate 8 is formed substantially like a half moon so as to be substantially identical to the focusing electrode support plate 7 and is formed with a circular opening 27 at a position opposed to the anode section 6, and the surroundings of the opening 27 are provided with three pin holes 28 into which the respective upper ends of the stem pins 10*c* are inserted. A riser 29 is disposed near each pin hole 28. Each riser 29 is made by lug-raising molding upon pressing carried out at the time of forming its corresponding pin hole 28. Since each riser 29 is employed, it is made easier for the upper end of each stem pin 10*c* to be secured to the focusing electrode plate 8 by welding. Further, the periphery of the focusing electrode plate 8 is provided with half-moon-shaped cutouts 30 for receiving the respective pipes 22, whereas the individual cutouts 30 correspond to the respective cutouts 26 of the focusing electrode support plate 7. In the focusing electrode plate 8, a tongue 31 is formed by bending between the cutouts 30, whereas the tongue 31 is caused to abut against the end portion of the focusing electrode support plate 7, thereby acting to position and hold the focusing electrode plate 8.

Figure 16:
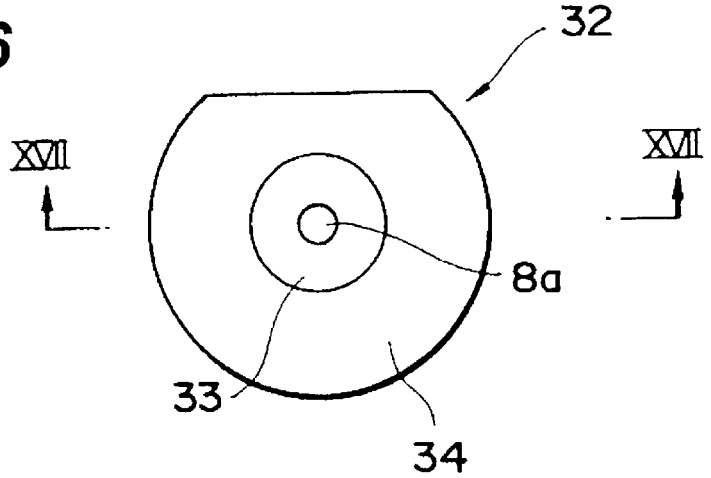
Figure 17:
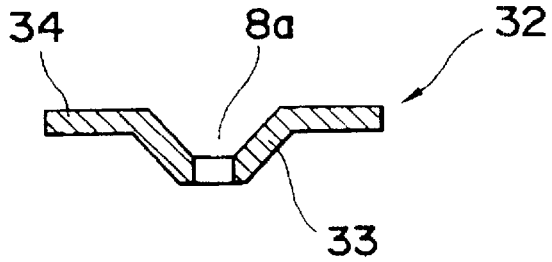
FIG. 17 is a sectional view thereof taken along the line XVII—XVII.
Figure 18:
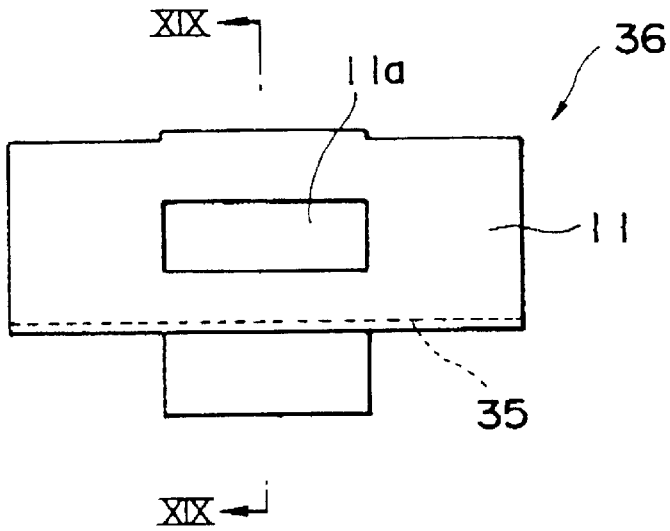
FIG. 18 is a front view showing the cathode surrounding portion in FIG. 1.
Figure 19:
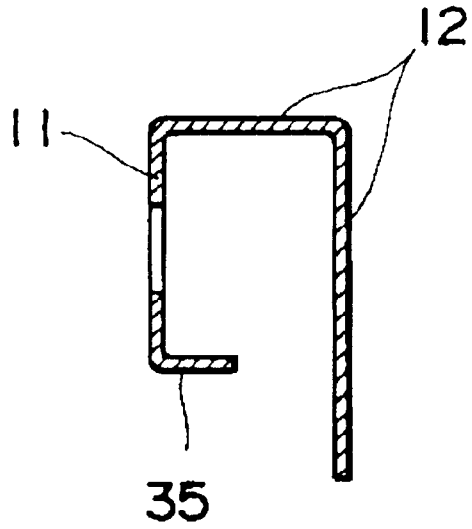
FIG. 19 is a sectional view thereof taken along the line XIX—XIX.
Figure 20:
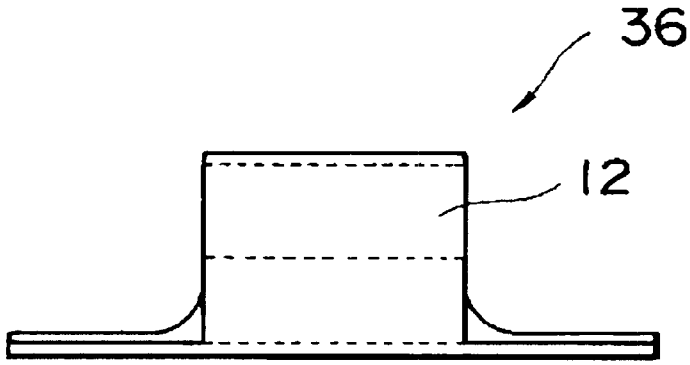
FIG. 20 is a plan view thereof.

As shown in FIGS. 3, 16, and 17, a metal-made aperture plate 32 having a funnel-shaped focusing aperture 8*a* is welded and secured to the upper face of the focusing electrode plate 8, the aperture plate 32 has a funnel-shaped focusing portion 33 for securing the focusing aperture 8*a*, and the focusing portion 33 is opposed to the anode section 6 as being inserted into the opening 27 of the focusing electrode plate 8. Further, the aperture plate 32 has a substantially half-moon-shaped flange portion 34 about the focusing portion 33, and the focusing electrode plate 8 and the aperture plate 32 are integrated with each other as the flange portion 34 is welded to the focusing electrode plate 8.

As shown in FIGS. 3 and 18 to 20, a metal-made cathode surrounding portion 36 formed by bending is secured to the upper face of the focusing electrode plate 8, whereas the discharge rectifying plate 11 disposed at the cathode surrounding portion 36 is integrated with the focusing electrode plate 8 by way of a welding piece 35. The discharge rectifying plate 11 perpendicularly rises from the upper face of the focusing electrode plate 8 and has the electron releasing window 11*a* as a rectangular opening for passing therethrough the thermions emitted from the cathode section 9. Also, the discharge rectifying plate 11 is provided with the cover plate 12 bent so as to yield an L-shaped cross section surrounding the upper side of the cathode section 9 and the rear side thereof opposite from the electron releasing window 11*a*. The cover plate 12 keeps the sputtering materials or evaporated materials released from the cathode section 9 from attaching to the light projection window 14*a* disposed at the top part of the sealed envelope 2. The discharge rectifying plate 11 and the cover plate 12 are integrally made as the cathode surrounding portion 36, which is secured to the upper face of the focusing electrode plate 8 by welding.

Here, a method of assembling the deuterium lamp 1 will be explained in brief with reference to FIGS. 1 and 3.

First, the stem 4 in which seven stem pins 10 and the exhaust pipe 13 are secured to the base 20 is prepared. Then, the pedestal 5*b* of the anode support plate 5 is caused to abut against the upper face 4*a* of the stem 4 such that the individual stem pins 10 penetrate through their corresponding pin holes 21. As a result, the stem pins 10 and pin holes 21 achieve secure positioning of the anode support plate 5 on the stem 4. Thereafter, the anode section 6 is contained in the cavity portion 5*a* of the anode support plate 5, and the risers 6*b* of the anode section 6 and the respective tips of the stem pins 10*a* are welded to each other (see FIG. 10). Subsequently, the pipes 22 made of ceramics are inserted into their corresponding pin holes 21*b* in the anode support plate 5 such that the individual stem pins 10*b* are plugged into the respective pipes 22. Thereafter, the focusing electrode support plate 7 is caused to abut onto the anode support plate 5 such that the individual stem pins 10*c* are inserted into their corresponding pin holes 24 of the focusing electrode support plate 7, and the anode section 6 is disposed between the anode support plate 5 and the focusing electrode support plate 7. Here, the half-moon-shaped anode plate 6B of the anode section 6 is disposed so as to be seen from the opening 7*a* of the focusing electrode support plate 7.

Thereafter, the respective tips of the stem pins 10*b* are welded and secured to the individual leads 9*a* provided on both sides of the cathode section 9. Then, the stem pins 10*c* are inserted into their corresponding pin holes 28 of the focusing electrode plate 8 such that the cover plate 12 of the focusing electrode plate 8 covers the cathode section 9, and the stem pins 10*c* are welded to their corresponding risers 29 of the focusing electrode plate 8 in a state where the focusing electrode plate 8 abuts against the focusing electrode support plate 7. Here, the cathode section 9 faces into the electron releasing window 11*a* of the discharge rectifying plate 11, whereas the anode plate 6B faces into the focusing opening 8*a* of the focusing electrode plate 8.

After thus being assembled onto the stem 4, the light-emitting part assembly 3 is covered with the side tube 14 from thereabove, and the metal-made flange portion 15*b* of the stem 4 and the metal-made flange portion 16*b* of the side tube 14 are brought into close contact with each other. While this state is being maintained, their joint part is subjected to a welding operation such as electric welding, laser welding, or the like, whereby the sealed envelope 2 is hermetically sealed. After the welding operation, energization is carried out for activating the cathode section 9. After the gases within the sealed envelope 2 are evacuated through the exhaust pipe 13, the sealed envelope 2 is filled with about several Torr of deuterium gas, and then the exhaust pipe 13 is closed, so that the sealed envelope 2 is hermetically sealed, whereby the operation of assembling the deuterium lamp 1 is completed.

Operations of thus configured gas discharge tube 1 will now be explained in brief. First, an electric power of about 10 W is supplied from an external power source to the cathode section 9 for about 20 seconds, so as to preheat the cathode section 9. Thereafter, a DC release voltage of about 150 V is applied across the cathode section 9 and the anode section 6, so as to prepare for arc discharge.

In the state where the preparation is in order, a trigger voltage of about 350 V to 500 V is applied across the cathode section 9 and the anode section 6. Here, while being rectified by the discharge rectifying plate 11, the thermions released from the cathode section 9 converge at the focusing opening 8*a* of the focusing electrode plate 8 and reach the anode plate 6B of the anode section 6. Then, arc discharge occurs in front of the focusing opening 8*a*, and ultraviolet rays taken out from the arc balls generated upon this arc discharge are transmitted through the light projection window 14*a* of the side tube 14 and released outside.

Without being restricted to the above-mentioned embodiment, the present invention can be modified in various manners. FIGS. 21A to 21F, 22A to 22F, 23A to 23F, and 24A to 24F are sectional views showing other embodiments of the light-emitting part assembly of the gas discharge tube in accordance with the present invention.

Figure 21A:
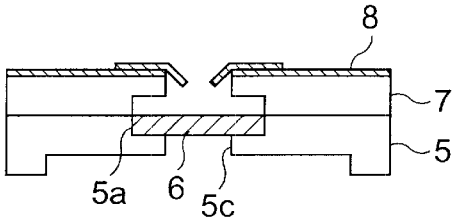
FIGS. 21A to 21F, 22A to 22F, 23A to 23F, and 24A to 24F are sectional views showing other embodiments of the light-emitting part assembly of the gas discharge tube in accordance with the present invention.

The light-emitting part assembly 3 shown in FIG. 21A has a configuration basically identical to that of the light-emitting part assembly 3 shown in FIG. 1. The light-emitting part assemblies 3 shown in FIGS. 21B, 21C differ from the above-mentioned configuration in that the focusing electrode support plate 7 is in contact with the anode support plate 5 at a position separated from the anode section 6. The light-emitting part assemblies 3 shown in FIGS. 21D to 21F differ from the light-emitting part assemblies 3 shown in FIGS. 21A to 21C in that the through hole 5*c* of the anode support plate 5 is eliminated, so that the anode section 6 is supported by the whole cavity portion 5*a*. The rear face of the anode supporting surface of the anode supporting plate 5 may be processed into various forms suitable for installing the anode support plate 5, and the like. Also, it is not necessary for the respective side faces of the anode support plate 5 and focusing electrode support plate 7 to be continuous with each other as shown in FIGS. 21A to 21F.

Figure 21D:
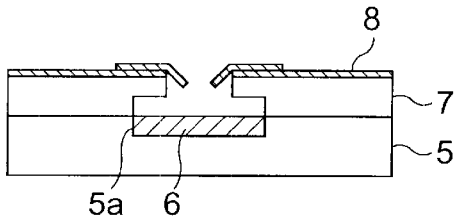
Figure 21B:
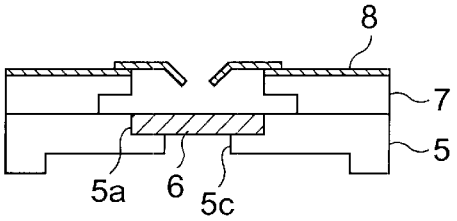
Figure 21E:
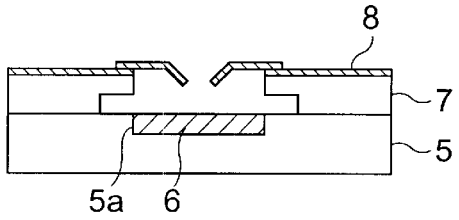
Figure 21C:
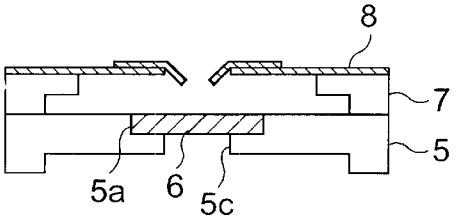
Figure 21F:
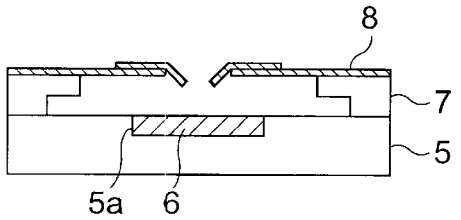
Figure 22A:
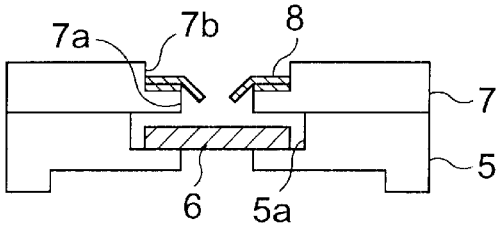
Figure 22D:
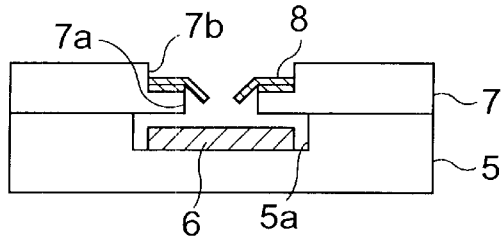
Figure 22B:
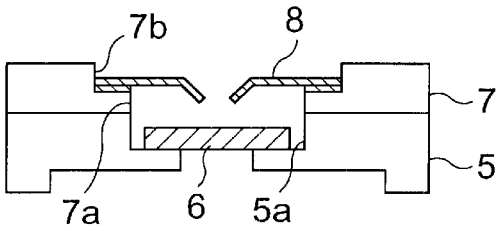
Figure 22E:
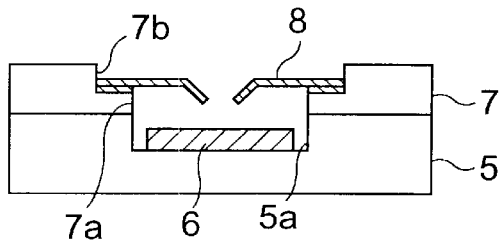
Figure 22C:
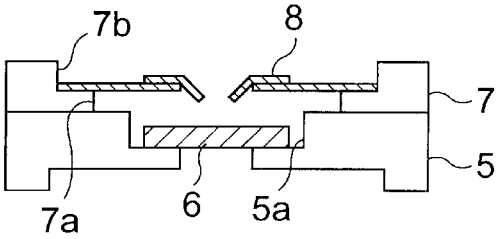
Figure 22F:
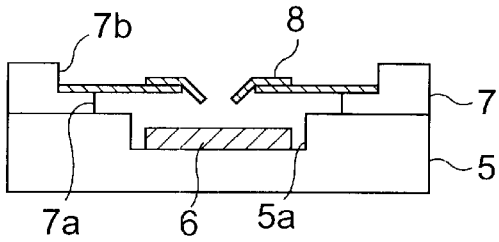
Figure 23A:
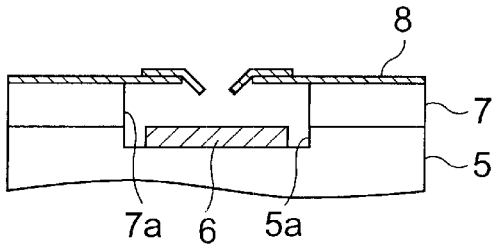
Figure 23D:
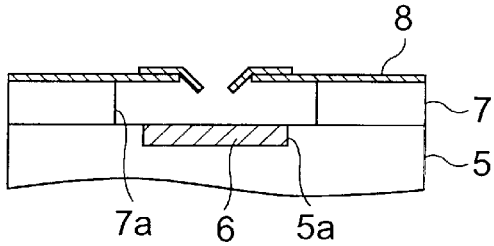
Figure 23B:
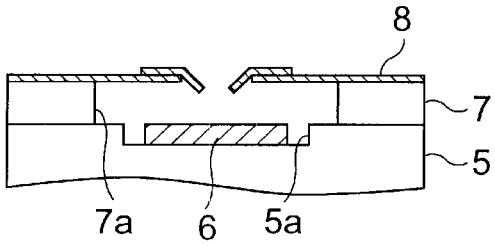
Figure 23E:
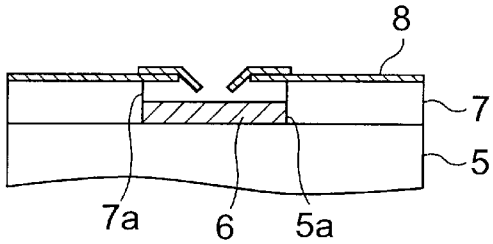
Figure 23C:
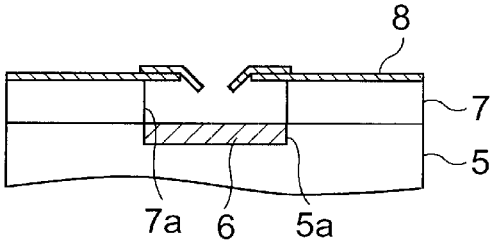
Figure 23F:
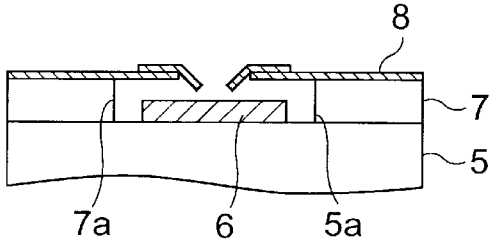
Figure 24A:
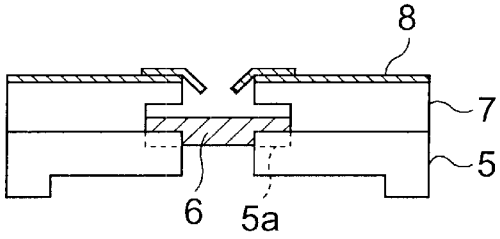
Figure 24D:
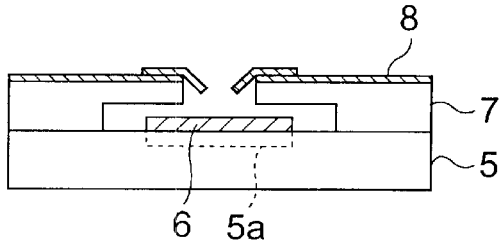
Figure 24B:
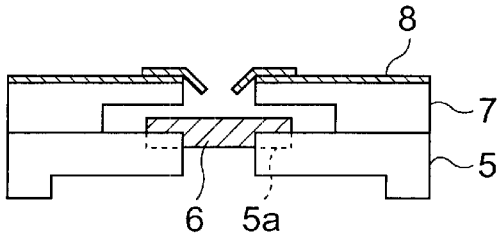
Figure 24E:
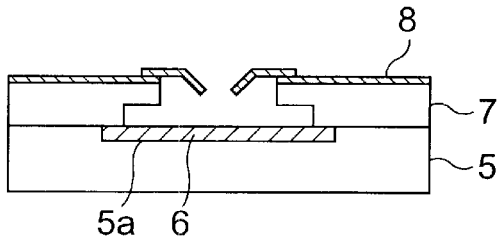
Figure 24C:
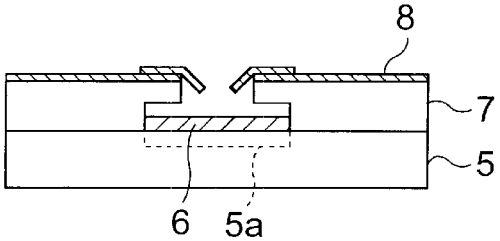
Figure 24F:
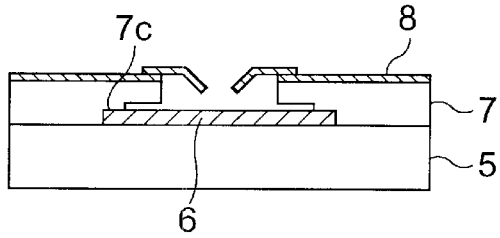

The light-emitting part assemblies 3 shown in FIGS. 22A to 22F are modified examples of the light-emitting part assemblies 3 shown in FIGS. 21D to 21F, and are each different therefrom in two points, i.e., that a cavity portion 7*b* is disposed in the front face of the focusing electrode support plate 7, so as to dispose and secure the focusing electrode plate 8 in the cavity portion 7*b*, and that the anode section 6 and the wall face of the cavity portion 5*a* of the anode support plate 5 are separated from each other.

The light-emitting part assemblies 3 shown in FIGS. 23A to 23F are modified examples of the light-emitting part assemblies 3 shown in FIGS. 21D to 21F, and are each different therefrom in that the diameter of the opening 7*a* of the focusing electrode support plate 7 is axially uniform. The light-emitting part assemblies 3 shown in FIGS. 23E, 23F further differ therefrom in that the anode support plate 5 does not have the cavity portion 5*a*, so that the anode section 6 is directly secured to the upper face thereof.

The light-emitting part assemblies 3 shown in FIGS. 24A to 24D are modified examples of the light-emitting part assemblies 3 shown in FIGS. 21A, 21B, 21D, and 21E, respectively, and are different therefrom in that the forms of the cavity portion 5*a* and anode section 6 are designed so as to mate with each other. Also, the light-emitting part assemblies 3 shown in FIGS. 24E, 24F differ from the other embodiments in that the anode section 6 is secured by being held between the anode support plate 5 and the focusing electrode support plate 7.

Though each of the anode support member and focusing electrode support member is formed from a single planar member in each of the examples explained here, each or one of the members may be constructed by a multilayer sheet or a plurality of sectored members, for example. When divided, the support members themselves enhance their processability, and it becomes easier to improve the accuracy in electrode disposition by the support members.

Though the individual support members explained are made of ceramics by way of example, both members may employ other materials as long as they are insulating members. Since both members can be subjected to high heat upon electric discharge, they are preferably made of heat-resistant members, and glass or the like is employable, for example.

Examples of the gas filling the sealed envelope 2 include not only deuterium gas but also hydrogen, mercury vapor, helium gas, neon gas, argon gas, or the like, and these gases should be chosen according to the use. The present invention is also applicable to side-on type discharge tubes as a matter of course.

While Kovar glass is used for the base 20 of the stem 4 in the foregoing explanations, ceramics may be used as well. Also, while the stem 4 is constituted by the base 20 through which the individual stem pins penetrate and the metal-made flange portion 15*b*, it may be a metal-made stem integrally molded with the flange portion 15*b*. In this case, each stem pin 10 may be secured to the metal-made stem 4 by use of hermetic seal of glass.

Since the gas discharge tube in accordance with the present invention is configured as in the foregoing, its light-emitting part is assembled easily, and its precision can be maintained. Also, the processing of each support member is easy, and it contributes to cutting down the manufacturing cost as well.

The present invention is suitably applicable to a gas discharge tube, such as a gas discharge tube for use as a light source for a spectroscope, chromatography, or the like in particular; and is employable as a deuterium lamp, mercury lamp, helium gas lamp, neon gas lamp, argon gas lamp, or the like, for example.

From the foregoing explanations of the invention, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside;

said gas discharge tube comprising:

an insulating anode support member mounting said anode section;

an insulating focusing electrode support member, mounted on a surface of said anode support member surrounding said anode section, having an opening on said anode section; and a focusing electrode, securely disposed at a front face of said opening of said focusing electrode support member, having a focusing opening projecting toward said anode section, wherein said cathode section is disposed on said anode support member or focusing electrode support member so as to be spaced from said focusing opening, at least one of said anode support member and focusing electrode support member having a portion with a shape fitting with side walls of said anode section so as to secure said anode section in a fixed position.

2. A gas discharge tube according to claim 1, wherein said anode support member has a cavity portion for mounting said anode section.

3. A gas discharge tube according to claim 1, wherein said anode section is secured by being held between said anode support member and said focusing electrode support member.

4. A gas discharge tube according to claim 1, wherein said anode support member and said focusing electrode support member are made of ceramics or glass.

5. A gas discharge tube according to claim 1, wherein said anode support member has a pin hole through which a stem pin securing said anode section to said sealed envelope penetrates.

6. A gas discharge tube according to claim 1, wherein said anode support member and said focusing electrode support member each have a pin hole through which a stem pin securing said focusing electrode to said sealed envelope penetrates.

7. A gas discharge tube according to claim 1, wherein said anode support member and said focusing electrode support member each have a pin hole through which a stem pin securing said cathode section to said sealed envelope penetrates.

8. A gas discharge tube according to claim 1, wherein said anode support member is disposed in contact with a stem, said stem forming a bottom face of said sealed envelope.

9. A gas discharge tube according to claim 1, wherein anode section is directly mounted on a top surface of said anode support member.

* * * * *